US005657824A

United States Patent [19]

Sundholm

[11] Patent Number: 5,657,824

[45] Date of Patent: Aug. 19, 1997

[54] DRIVE UNIT FOR FIRE FIGHTING INSTALLATION

[76] Inventor: Göran Sundholm, Ilmari Kiannon kuja 3, FIN-04310 Tuusula, Finland

[21] Appl. No.: 535,295

[22] PCT Filed: May 4, 1994

[86] PCT No.: PCT/FI94/00171

§ 371 Date: Nov. 3, 1995

§ 102(e) Date: Nov. 3, 1995

[87] PCT Pub. No.: WO94/25114

PCT Pub. Date: Nov. 10, 1994

[30] Foreign Application Priority Data

May 5, 1993 [FI] Finland ..... 932037

[51] Int. Cl.[6] ..... A62C 35/68

[52] U.S. Cl. ..... 169/9; 169/14

[58] Field of Search ..... 169/5, 6, 7, 8, 169/9, 14, 56, 60, 61; 137/118.07, 119.08, 119.09; 222/61, 144.5, 145.1, 399

[56] References Cited

U.S. PATENT DOCUMENTS 3,012,613 12/1961 Diquattro ..... 169/9
4,224,994 9/1980 Tone et al. ..... 169/9

FOREIGN PATENT DOCUMENTS 1215724 3/1986 U.S.S.R. ..... 169/14

*Primary Examiner*—Andrew C. Pike
*Attorney, Agent, or Firm*—Ladas & Parry

[57] ABSTRACT

A drive unit for a fire fighting installation operating with a high drive pressure has at least one drive gas container charged to a high pressure and at least first and second groups of hydraulic accumulators selectively connectable to the at least one drive gas container and connections which initially connect only the first group of the hydraulic accumulators to the at least one drive gas container and subsequently connect the second group of hydraulic accumulators to the at least one drive gas container.

2 Claims, 1 Drawing Sheet

DRIVE UNIT FOR FIRE FIGHTING INSTALLATION

Figure 1:
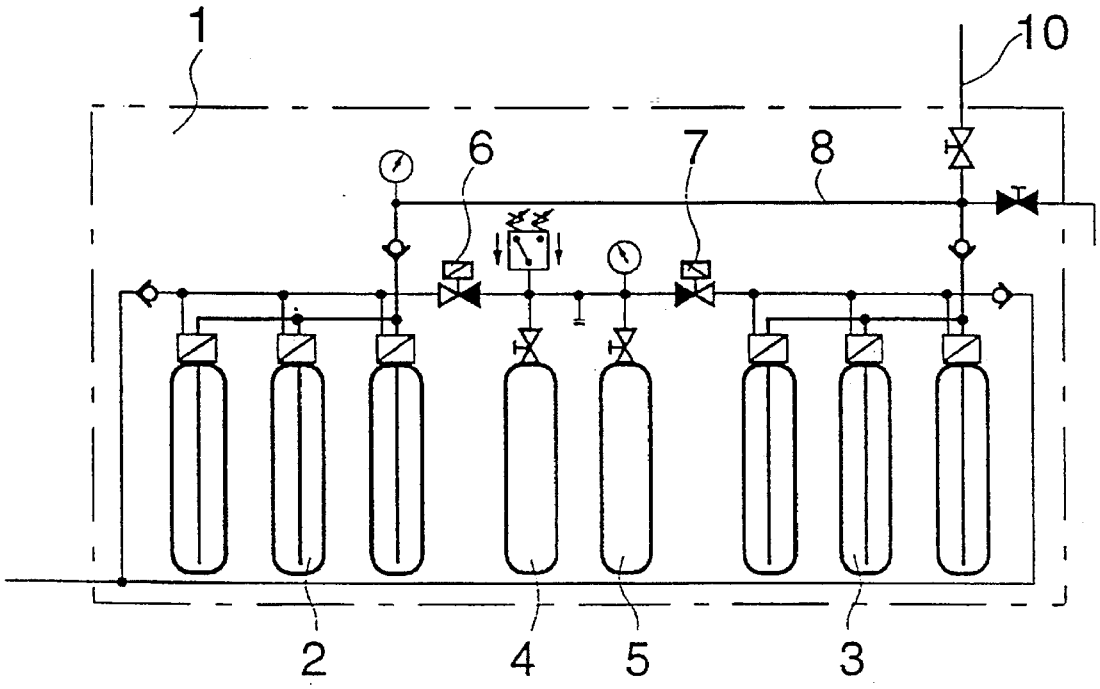

The present invention relates to a drive unit, in particular for a fire fighting installation intended to operate with a high drive pressure, said unit comprising a number of hydraulic accumulators coupled in parallel.

Finnish patent application 931405 discloses, among other things, a drive unit of the above-mentioned type in which the liquid of the hydraulic accumulators is driven out by means gas fed in under a high pressure from pressure gas containers. The pressure gas containers are often called gas bottles in daily speech after a beginning stage of liquid delivery only, the gas is delivered with the liquid.

A problem with standard made gas bottles is that their outlet valve is small, due to which a sufficiently large gas flow is not obtained. A large gas flow is a necessity for the primary requirement to in the beginning of the extinguishing process obtain a large water flow, likewise also for the somewhat more secondary requirement to be able to deliver cooling water for a longer time.

The object of the invention is to provide a new drive unit which eliminates the above drawback and enables efficient extinguishing.

The drive unit according to the invention is mainly characterized in that the hydraulic accumulators are divided into at least two groups optionally connectable to at least one drive gas container charged to a high pressure, and that said at least one drive gas container is arranged to in a beginning stage be connected to a first group of hydraulic accumulators and in a later stage be connected to another group of hydraulic accumulators.

During the later stage the connection to the beginning stage group of hydraulic accumulators is preferably closed.

The invention shall in the following be described in more detail, with reference to a preferred exemplifying embodiment shown in the attached drawing.

In the drawing the drive unit is generally indicated by the reference numeral 1. The drive unit 1 comprises two groups of hydraulic accumulators, preferably of the type described in the U.S. patent application No. 931,405 and indicated by 2 and 3, respectively. Each group can comprise e.g., three accumulators, as in the drawing.

Two gas bottles, the initial charge pressure of which can be 200 bar, are indicated by 4 and 5. The bottles 4 and 5 can via a valve 6 be connected to the accumulator group 2 and via a valve 7 be connected to the accumulator group 3.

When the drive unit 1 is activated due to a fire alarm, only one of the valves 6 and 7 is opened to begin with, e.g., the valve 6 to the accumulator group 2. In this first stage both gas bottles 4 and 5 drive out liquid from the group 2 only through the group out-going line 8 to the out-going line 10 of the whole drive unit 1.

When the pressure in the gas bottles 4 and 5 has fallen to a predermined value, e.g., 130 bar, the hereto open valve 6 is closed and instead the hereto closed valve 7 is opened. In spite of fallen and continuously falling drive pressure in the gas bottles 4 and 5 these are capable of effectively emptying the accumulator group 3 via the out-going line 9 of that group to the out-going line 10 of the drive unit 1.

When the first opened valve 6 is closed, a considerable amount of gas has already flown into the upper part of the accumulators 2, and when closing the valve 6 this gas has still a relatively high pressure, e.g., 130 bar. The entrapped gas continues to expand in the accumulators 2 and completes the emptying of these at the same time as the gas bottles 4 and 5 empty the accumulators 3.

In this way a relatively low number of gas bottles can efficiently be utilized for driving liquid out of a relatively large number of hydraulic accumulators. In principle one can have more than two groups of accumulators; alternatively it can be contemplated to during the second stage keep the first opened valve 6 continuously at least partially open.

I claim:

1. A drive unit for a fire fighting installation operating with a high drive pressure, said drive unit comprising at least one drive gas container (4, 5) charged to a high pressure, at least first and second groups (2, 3) of hydraulic accumulators selectively connectable to said at least one drive gas container, and means for initially selectively connecting only said first group of said hydraulic accumulators to said at least one drive gas container and for subsequently selectively connecting said second group of said hydraulic accumulators to said at least one drive gas container.

2. A drive unit according to claim 1, wherein said means comprising a first connection (6) for selectively connecting said first group (2) of said hydraulic accumulators to said at least one drive gas container and a second connection (7) for selectively connecting said second group (3) of said hydraulic accumulators to said at least one drive gas container, and wherein said first connection is closed when said second connection is opened.

* * * * *